US008042520B2

(12) United States Patent
Miller et al.

(10) Patent No.: US 8,042,520 B2
(45) Date of Patent: Oct. 25, 2011

(54) ENGINE STARTUP FUEL PRESSURE CONTROL SYSTEMS AND METHODS

(75) Inventors: Jon C. Miller, Fenton, MI (US); Robert C. Gibson, Canton, MI (US); Kauser Ferdous, West Bloomfield, MI (US)

(73) Assignee: GM Global Technology Operations LLC

( * ) Notice: Subject to any disclaimer, the term of this patent is extended or adjusted under 35 U.S.C. 154(b) by 321 days.

(21) Appl. No.: 12/482,675

(22) Filed: Jun. 11, 2009

(65) Prior Publication Data

US 2010/0288235 A1 Nov. 18, 2010

Related U.S. Application Data

(60) Provisional application No. 61/177,392, filed on May 12, 2009.

(51) Int. Cl.
*F02M 59/36* (2006.01)
*G06F 19/00* (2011.01)

(52) U.S. Cl. ..... 123/458; 123/464; 701/102; 701/113; 701/114; 701/115

(58) Field of Classification Search ..... 123/457, 123/458, 464; 701/102–104, 113–115
See application file for complete search history.

(56) References Cited

U.S. PATENT DOCUMENTS

| | | | | |
|---|---|---|---|---|
| 6,296,012 | B1 * | 10/2001 | Kilgore et al. | 137/468 |
| 6,453,878 | B1 * | 9/2002 | Mazet | 123/497 |
| 6,513,371 | B1 * | 2/2003 | Jett et al. | 73/114.42 |
| 6,701,905 | B1 * | 3/2004 | Gaskins | 123/674 |
| 7,066,155 | B2 * | 6/2006 | Uhde et al. | 123/525 |
| 7,124,628 | B2 * | 10/2006 | Wildman | 73/114.43 |
| 7,624,719 | B2 * | 12/2009 | Achleitner et al. | 123/456 |
| 7,624,720 | B1 * | 12/2009 | Dokas et al. | 123/458 |
| 7,774,125 | B2 * | 8/2010 | Scharfenberg | 701/103 |
| 7,810,470 | B2 * | 10/2010 | Scharfenberg | 123/446 |
| 2003/0047169 | A1 * | 3/2003 | Buse et al. | 123/457 |
| 2006/0064227 | A1 * | 3/2006 | Uhde et al. | 701/104 |
| 2007/0193559 | A1 * | 8/2007 | Tokuda et al. | 123/463 |

* cited by examiner

*Primary Examiner* — Thomas Moulis

(57) ABSTRACT

A fuel pressure control system for a vehicle comprises a pressure regulator module and a pressure increasing module. The pressure regulator module regulates a fuel pressure supplied to an engine to a first predetermined pressure during an engine running period. The pressure increasing module selectively increases the fuel pressure to a second predetermined pressure during the engine running period when a counter value is one of greater than and less than a predetermined final value. The second predetermined pressure is greater than the first predetermined pressure, and the counter value is set to the predetermined final value after the engine is started for a first time after being assembled.

20 Claims, 3 Drawing Sheets

ENGINE STARTUP FUEL PRESSURE CONTROL SYSTEMS AND METHODS

CROSS-REFERENCE TO RELATED APPLICATIONS

This application claims the benefit of U.S. Provisional Application No. 61/177,392, filed on May 12, 2009. The disclosure of the above application is incorporated herein by reference in its entirety.

FIELD

The present disclosure relates to internal combustion engines and more particularly to fuel pressure control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into gasoline engines is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders. Increasing the amount of air and fuel provided to the cylinders increases the torque output of the engine.

The fuel that is combusted by the engine is stored in a fuel tank. A low pressure pump draws fuel from the fuel tank. The low pressure pump pressurizes the fuel and supplies low pressure fuel to a high pressure pump. The high pressure pump further pressurizes the fuel and supplies the pressurized fuel to one or more fuel injectors.

An engine control module (ECM) controls the amount and timing of fuel injection, torque output by the engine, and other parameters. The ECM may also diagnose faults in one or more components of the vehicle. These faults may be used to, for example, notify a driver to seek service and aid a service technician in servicing the vehicle.

SUMMARY

A fuel pressure control system for a vehicle comprises a pressure regulator module and a pressure increasing module. The pressure regulator module regulates a fuel pressure supplied to an engine to a first predetermined pressure during an engine running period. The pressure increasing module selectively increases the fuel pressure to a second predetermined pressure during the engine running period when a counter value is one of greater than and less than a predetermined final value. The second predetermined pressure is greater than the first predetermined pressure, and the counter value is set to the predetermined final value after the engine is started for a first time after being assembled.

In other features, the pressure increasing module determines whether to increase the fuel pressure based on an engine coolant temperature and the engine running period when the counter value is the one of greater than and less than the predetermined final pressure.

In still other features, the pressure increasing module increases the fuel pressure to the second predetermined pressure when the engine coolant temperature is within a predetermined temperature range, the engine running period is less than a predetermined period, and the counter value is the one of greater than and less than the predetermined final pressure.

In further features, the pressure regulator module selectively decreases the fuel pressure to a third predetermined pressure that is less than the first predetermined pressure.

In still further features, the fuel pressure control system further comprises an engine runtime module. The engine runtime module starts the engine running period when an engine speed is greater than a predetermined speed.

In other features, the fuel pressure control system further comprises an engine runtime module. The engine runtime module starts the engine running period when an engine speed is greater than a predetermined speed for a predetermined number of combustion events.

In still other features, the fuel pressure control system further comprises an engine runtime module. The engine runtime module starts the engine running period when an engine speed is greater than a predetermined speed for a predetermined number of consecutive combustion events.

In further features, the first predetermined pressure is approximately four-hundred (400) kPa and the second predetermined pressure is approximately four-hundred, fifty (450) kPa.

In still further features, the second predetermined pressure is approximately twenty (20) percent greater than the first predetermined pressure.

In other features, the second predetermined pressure is approximately thirty (30) percent greater than the first predetermined pressure.

A fuel pressure control method for a vehicle comprises regulating a fuel pressure supplied to an engine to a first predetermined pressure during an engine running period and selectively increasing the fuel pressure to a second predetermined pressure during the engine running period when a counter value is one of greater than and less than a predetermined final value. The second predetermined pressure is greater than the first predetermined pressure, and the counter value is set to the predetermined final value after the engine is started for a first time after being assembled.

In other features, the fuel pressure control method further comprises determining whether to increase the fuel pressure based on an engine coolant temperature and the engine running period when the counter value is the one of greater than and less than the predetermined final pressure.

In still other features, the fuel pressure control method further comprises increasing the fuel pressure to the second predetermined pressure when the engine coolant temperature is within a predetermined temperature range, the engine running period is less than a predetermined period, and the counter value is the one of greater than and less than the predetermined final pressure.

In further features, the fuel pressure control method further comprises selectively decreasing the fuel pressure to a third predetermined pressure that is less than the first predetermined pressure.

In still further features, the fuel pressure control method further comprises starting the engine running period when an engine speed is greater than a predetermined speed.

In other features, the fuel pressure control method further comprises starting the engine running period when an engine speed is greater than a predetermined speed for a predetermined number of combustion events.

In still other features, the fuel pressure control method further comprises starting the engine running period when an engine speed is greater than a predetermined speed for a predetermined number of consecutive combustion events.

In further features, the first predetermined pressure is approximately four-hundred (400) kPa and the second predetermined pressure is approximately four-hundred, fifty (450) kPa.

In still further features, the second predetermined pressure is approximately twenty (20) percent greater than the first predetermined pressure.

In other features, the second predetermined pressure is approximately thirty (30) percent greater than the first predetermined pressure.

Further areas of applicability of the present disclosure will become apparent from the detailed description provided hereinafter. It should be understood that the detailed description and specific examples are intended for purposes of illustration only and are not intended to limit the scope of the disclosure.

DETAILED DESCRIPTION

Figure 1:
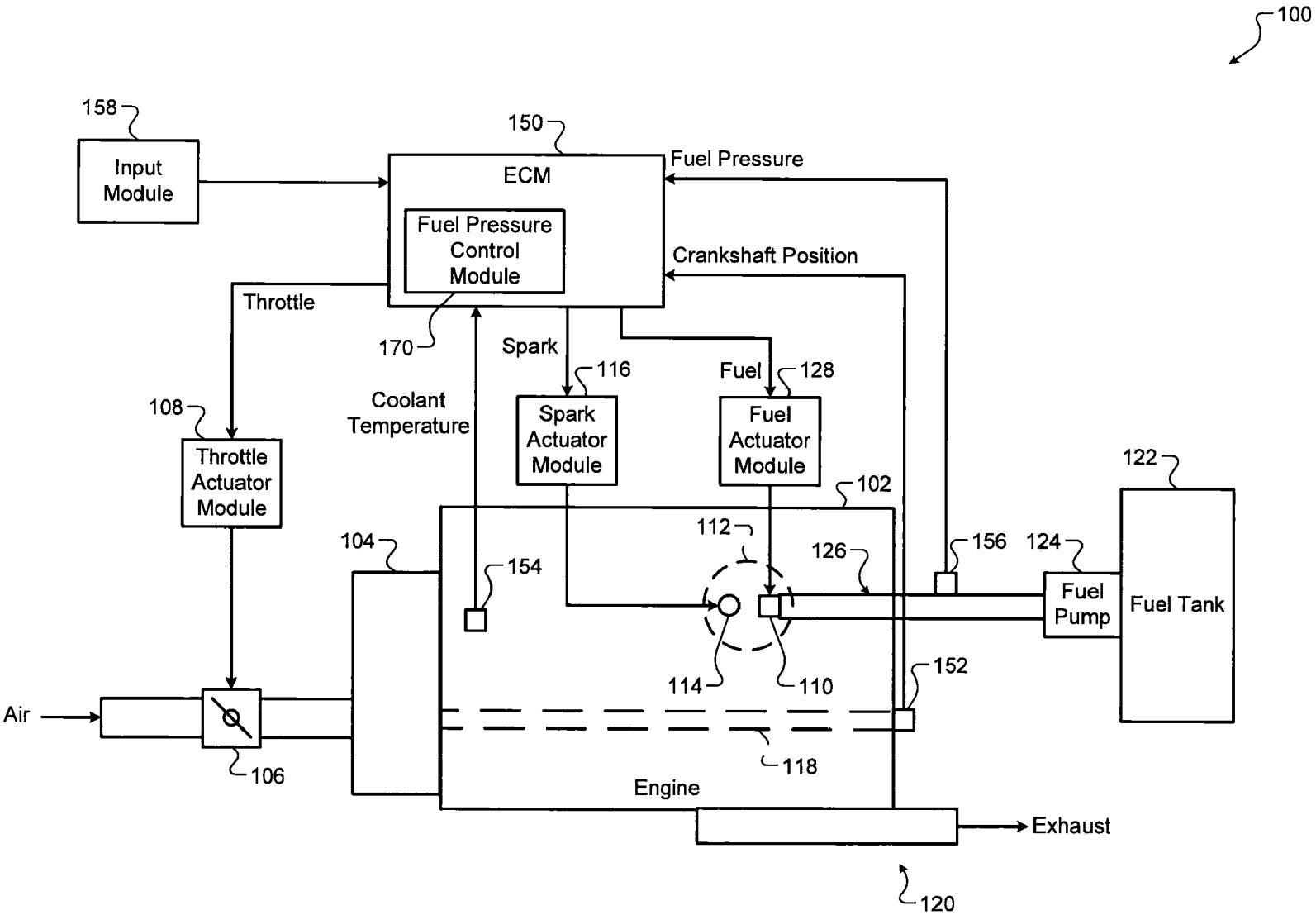
FIG. 1 is a functional block diagram of an exemplary engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A fuel system supplies fuel to an engine for combustion. A fuel pump pressurizes fuel within a fuel rail. Fuel injectors supply fuel from the fuel rail to the engine. A fuel pressure control module regulates the pressure of the fuel within the fuel rail (i.e., fuel pressure) based on a predetermined startup pressure when engine startup is initiated.

During vehicle assembly, however, air is trapped within the fuel rail. When the engine is started for a first time (e.g., at an assembly plant), air trapped within the fuel rail may prevent the fuel pressure control module from providing a desired air/fuel mixture. More specifically, air trapped within the fuel rail may be purged from the fuel rail to the engine and cause the air/fuel mixture to be lean. The lean air/fuel mixture may cause, for example, engine misfire, stalling, and/or setting of one or more codes in diagnostic memory.

The fuel pressure control module of the present disclosure selectively increases the fuel pressure to a predetermined purging pressure when the engine is started for the first time. The predetermined purging pressure is greater than the predetermined startup pressure. Increasing the fuel pressure to the predetermined purging pressure decreases the volume of air (i.e., compresses the air) trapped within the fuel rail, which enables the fuel pressure control module to more accurately control the air/fuel mixture.

Referring now to FIG. 1, a functional block diagram of an engine system 100 is presented. Air is drawn into an engine 102 through an intake manifold 104. A throttle valve 106 is actuated by a throttle actuator module 108 to vary the volume of air drawn into the engine 102. The throttle actuator module 108 may include, for example, an electronic throttle controller (ETC). The air mixes with fuel from one or more fuel injector (e.g., fuel injector 110) to form an air/fuel mixture. The air/fuel mixture is combusted within one or more cylinders of the engine 102, such as cylinder 112.

A spark plug 114 may initiate combustion of the air/fuel mixture within the cylinder 112. A spark actuator module 116 controls the provision of spark by the spark plug 114. Although one fuel injector, spark plug, and cylinder are shown, the engine 102 may include more or fewer fuel injectors, spark plugs, and/or cylinders. For example only, the engine 102 may include 2, 3, 4, 5, 6, 8, 10, or 12 cylinders. One fuel injector and spark plug may be provided for each cylinder of the engine 102. Drive torque generated by combustion of the air/fuel mixture is output from the engine 102 via a crankshaft 118. Exhaust gas resulting from combustion is expelled from the engine 102 to an exhaust system 120.

Before combustion, fuel is stored in a fuel tank 122. A fuel pump 124 draws fuel from the fuel tank 122 and pressurizes the fuel within a fuel rail 126. The fuel rail 126 supplies pressurized fuel to the fuel injector 110. While the fuel injector 110 is shown in FIG. 1 as injecting fuel directly into the cylinder 112, the fuel injector 110 may inject fuel into other suitable locations. For example only, the fuel injector 110 may inject fuel into the intake manifold 104, near an intake valve associated with each of the cylinders, and/or into mixing chambers associated with each of the cylinders.

A fuel actuator module 128 controls opening of the fuel injector 110 based on signals from an engine control module (ECM) 150. In this manner, the ECM 150 controls the timing of fuel injection and the amount of fuel injected by the fuel injector 110. The ECM 150 also controls other engine actuators, such as the throttle actuator module 108 and the spark actuator 116.

One or more sensors may also be implemented in the engine system 100. For example only, the engine system 100 includes a crankshaft sensor 152. The crankshaft sensor 152 measures the position of the crankshaft 118 and outputs the crankshaft position signal accordingly. For example only, the crankshaft sensor 152 may include a variable reluctance (VR) sensor or another suitable type of crankshaft sensor.

The crankshaft position signal may include a pulse train. Each pulse of the pulse train may be generated as a tooth of an N-toothed wheel (not shown) that rotates with the crankshaft 118, passes the VR sensor. Accordingly, each pulse corresponds to an angular rotation of the crankshaft 118 by an amount equal to 360° divided by N teeth. The N-toothed wheel may also include a gap of one or more missing teeth, and the gap may be used as an indicator of one complete rotation of the crankshaft 118.

The engine system 100 also includes a coolant temperature sensor 154. The coolant temperature sensor 154 measures the temperature of engine coolant and outputs a coolant temperature signal accordingly. The coolant temperature sensor 154 may be located within the engine 102 or at another location where the coolant is circulated, such as a radiator (not shown). A fuel pressure sensor 156 measures the fuel pressure within the fuel rail 126 and outputs a fuel pressure signal accordingly.

The ECM 150 controls operation (i.e., activation/deactivation) of the fuel pump 124 to regulate the fuel pressure within the fuel rail 126. For example only, the ECM 150 may maintain the fuel pressure at a predetermined operating pressure (e.g., approximately 250 kPa) during normal engine operation.

Engine startup commands are relayed to the ECM 150 by an input module 158. An engine startup command may be generated based on, for example, turning of a key or depression of a button (not shown). A starter (not shown) engages and drives rotation of the crankshaft 118 when an engine startup command is received.

An engine cranking period may be said to begin when the starter engages or when the engine startup command is received. The engine cranking period may extend to when, for example, an engine speed exceeds a predetermined speed (e.g., approximately 500 rpm) for a predetermined number of consecutive combustion events (e.g., four in an engine having four cylinders). When the engine speed exceeds the predetermined speed for the predetermined number of combustion events, an engine running period may be said to begin.

During the engine running period, the ECM 150 generally controls the fuel pump 124 to achieve a predetermined startup pressure. The predetermined startup pressure may be calibratable and may be set based on, for example, a maximum fuel pressure that the fuel pump 124 may sustain over a period of time. For example only, the predetermined startup pressure may be approximately 400 kPa. Once the fuel pressure reaches the predetermined startup pressure, the ECM 150 may decrease the fuel pressure to the predetermined operating pressure.

Air is trapped within the fuel rail 126, however, during assembly of the engine system 100. When the engine 102 is started for a first time (e.g., at an assembly plant), the air trapped within the fuel rail 126 during assembly may prevent the ECM 150 from supplying a desired air/fuel mixture to the engine 102. More specifically, air trapped within the fuel rail 126 may be expelled from the fuel rail 126 into the cylinder 112. The injection of air to the cylinder 112 may cause the air/fuel mixture combusted within the cylinder 112 to be lean (i.e., have an equivalence ratio (EQR) of less than a stoichiometric EQR of 1.0). The lean air/fuel mixture may cause, for example, engine misfire, stalling, and/or setting of one or more codes in diagnostic memory (not shown).

The ECM 150 of the present disclosure includes a fuel pressure control module 170 that increases the fuel pressure during the engine running period when the engine 102 is started for the first time. The fuel pressure control module 170 increases the fuel pressure to a predetermined purging pressure that is greater than the predetermined startup pressure. Increasing the fuel pressure to the predetermined purging pressure decreases the volume of air (i.e., compresses the air) within the fuel rail 126, which enables the ECM 150 to more accurately control the air/fuel mixture.

While the fuel pressure control module 170 is shown and described herein as being located within the ECM 150, the fuel pressure control module 170 may be located in another suitable location. For example only, in other implementations, the fuel pressure control module 170 may be implemented externally to the ECM 150 and may be located near the fuel tank 122. In such implementations, the fuel pressure control module 170 may control the fuel pressure based on a desired fuel pressure provided by the ECM 150. The ECM 150 may set the desired fuel pressure to the predetermined purging pressure during the engine running period when the engine 102 is started for the first time.

Figure 2:
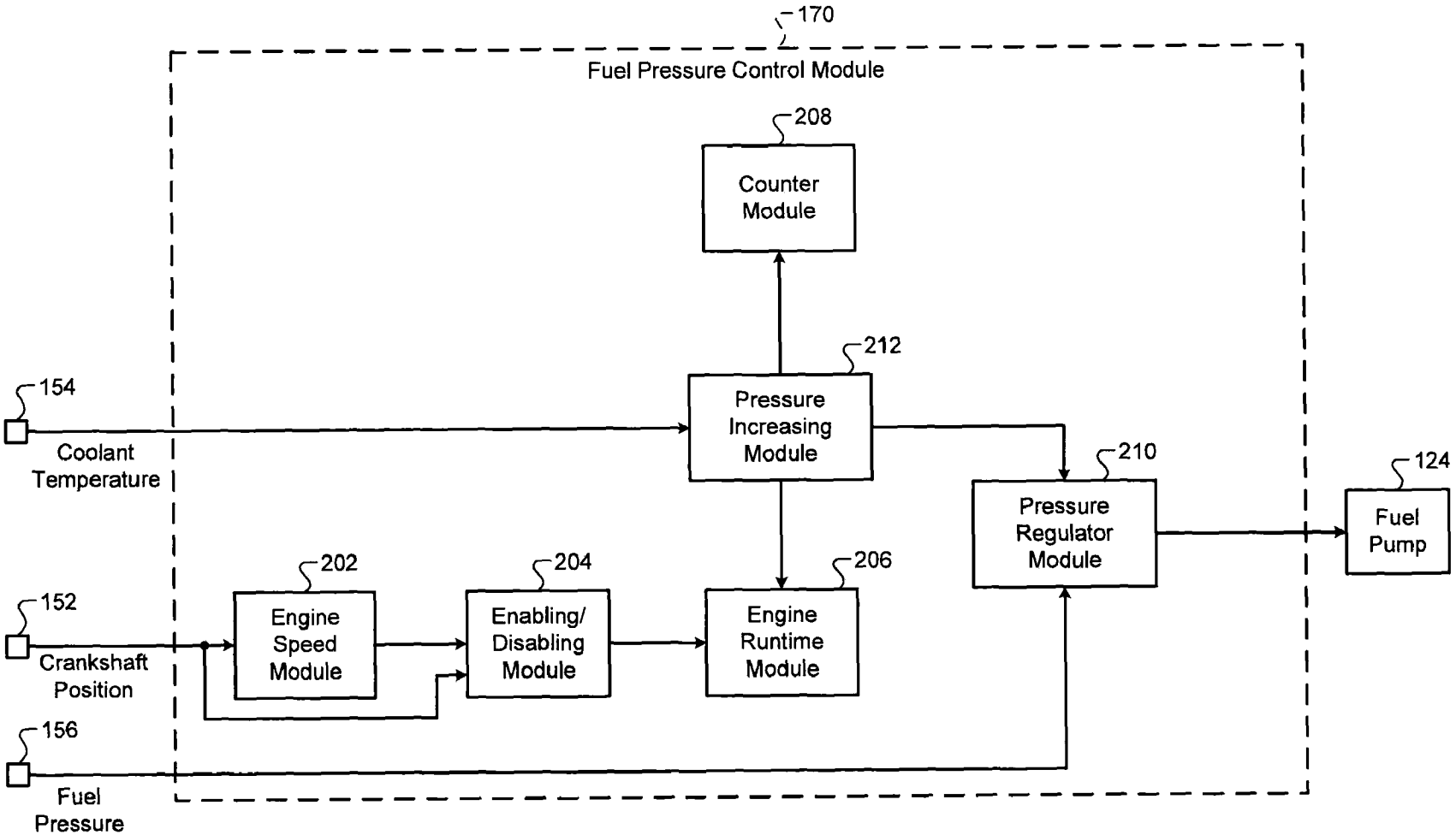
FIG. 2 is a functional block diagram of an exemplary fuel pressure control system according to the principles of the present disclosure.

Referring now to FIG. 2, a functional block diagram of an exemplary implementation of the fuel pressure control module 170 is presented. The fuel pressure control module 170 includes an engine speed module 202, an enabling/disabling module 204, an engine runtime module 206, and a counter module 208. The fuel pressure control module 170 also includes a pressure regulator module 210 and a pressure increasing module 212.

The engine speed module 202 determines the rotational speed of the engine 102 (i.e., the engine speed) in revolutions per minute (rpm). In one implementation, the engine speed module 202 determines the engine speed based on the crankshaft signal provided by the crankshaft sensor 152. For example only, the engine speed module 202 may determine the engine speed based on the period of time between the pulses of the pulse train output by the crankshaft sensor 152.

The enabling/disabling module 204 determines whether the engine running period has begun based on the engine speed. The enabling/disabling module 204 selectively starts an engine runtime timer when the engine running period has begun. The engine running period begins (and the enabling/disabling module 204 starts the engine runtime timer) when the engine speed is greater than the predetermined speed for the predetermined number of combustion events.

For example only, the predetermined speed may be approximately 500 rpm and the predetermined number of combustion events may be four consecutive combustion events in engines having four cylinders. The engine runtime timer is reset to a predetermined reset value (e.g., zero) before being started. In this manner, the engine runtime timer tracks how long the engine 102 has been running (i.e., the engine runtime period).

The pressure regulator module 210 regulates the fuel pressure within the fuel rail 126 by controlling the fuel pump 124. The pressure regulator module 210 may use feedback from the fuel pressure sensor 156 in regulating the fuel pressure.

The pressure regulator module 210 regulates the fuel pressure based on the predetermined startup pressure during the engine running period. The predetermined startup pressure may be calibratable and may be set based on, for example, a maximum fuel pressure that is sustainable by the fuel pump 124. For example only, the predetermined startup pressure may be approximately 400 kPa. Later, the pressure regulator module 210 may decrease the fuel pressure and regulate the fuel pressure based on the predetermined operating pressure.

The pressure increasing module 212 selectively increases the fuel pressure to the predetermined purging pressure during the engine running period when the engine 102 is started for the first time. The pressure increasing module 212 determines whether to increase the fuel pressure based on whether the engine 102 has previously been started, the coolant temperature, and the engine runtime period.

The pressure increasing module 212 may increase the fuel pressure when the engine 102 is started for the first time, the coolant temperature is within a predetermined temperature range, and the engine runtime period is less than a predetermined period. For example only, the predetermined temperature range may be bounded by temperatures of approximately 10° C. and 60° C. and the predetermined period may be approximately 90 seconds.

The pressure increasing module 212 may determine whether the engine 102 has previously been started based on a counter value. The counter value may be obtained from, for example, the counter module 208. For example only, the counter value may be implemented in the form of a manufacturer's enabling counter (MEC).

The counter value is initially set (e.g., by an ECM supplier) to a predetermined initial value. For example only, the counter value may be set to the predetermined initial value of 255. The counter value may be adjusted on one or more occasions after the engine 102 is started for the first time. In one implementation, the pressure increasing module 212 may determine that the engine 102 has previously been started when the counter value different than the predetermined initial value.

The counter value may also be set to a predetermined final value after the engine 102 is started for the first time. In one implementation, the counter value is set to the predetermined final value after the vehicle passes end of assembly diagnostics. For example only, the predetermined final value may be zero. In such an implementation, the pressure increasing module 212 may determine that the engine 102 has not previously been started until the counter value is equal to the predetermined final value. Further, the fuel pressure may be increased in some circumstances even after the engine 102 is started for the first time, such as if the engine 102 stalls during the first running of the engine 102.

When increasing the fuel pressure, the pressure increasing module 212 increases the fuel pressure to the predetermined purging pressure. For example only, the predetermined purging pressure may be approximately 20-30% more than the predetermined startup pressure or approximately 450 kPa. Increasing the fuel pressure to the predetermined purging decreases the volume of air (i.e., compresses the air) trapped within the fuel rail 126 and enables the ECM 150 to more accurately control the air/fuel mixture.

Figure 3:
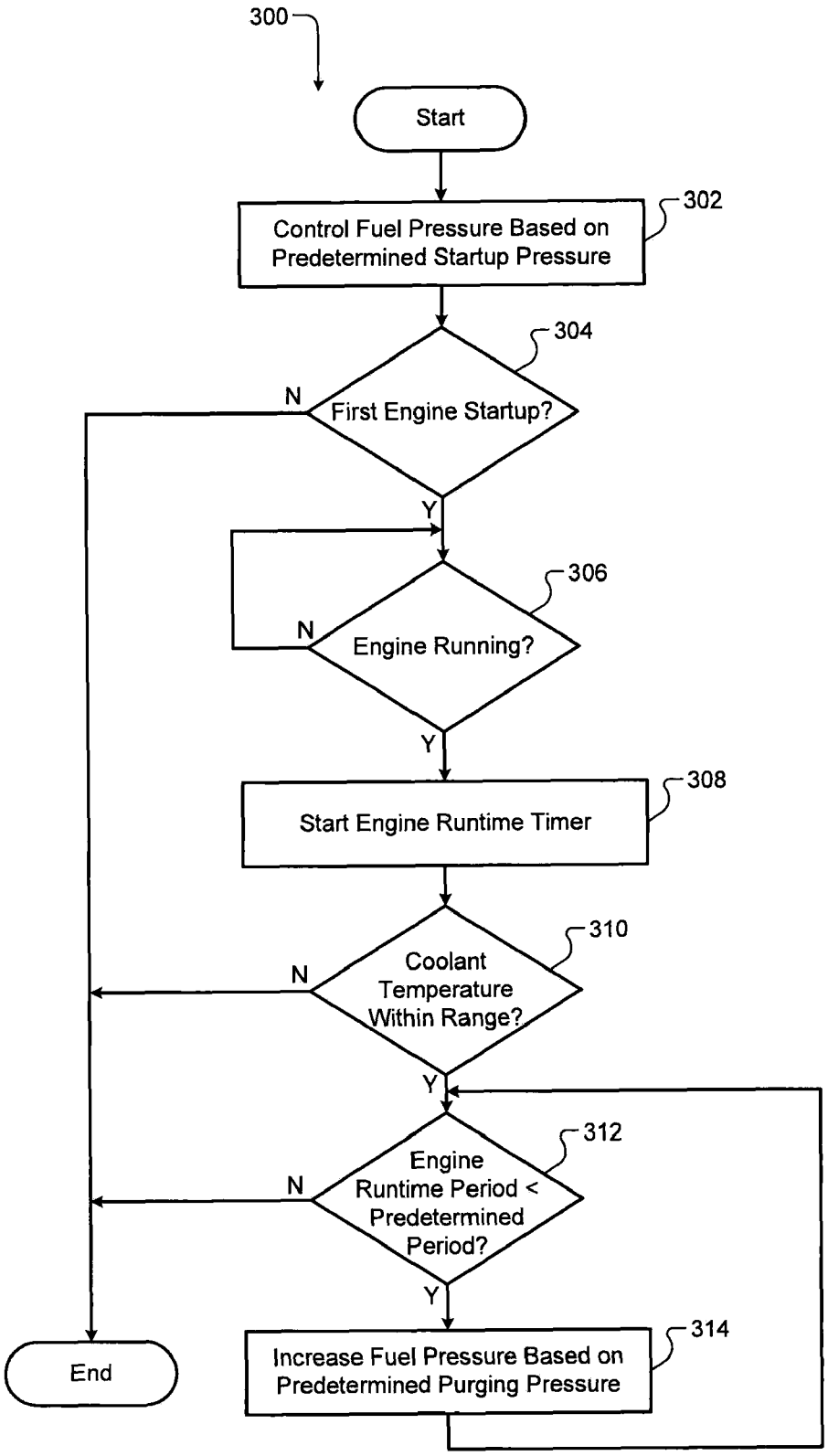
FIG. 3 is a flowchart depicting an exemplary method according to the principles of the present disclosure.

Referring now to FIG. 3, a flowchart depicting an exemplary method 300 is presented. The method 300 begins in step 302 after the engine startup command is received where the method 300 controls the fuel pressure based on the predetermined startup pressure. The method 300 determines whether this is the first time that the engine 102 has been started after being assembled in step 304. If true, the method 300 continues to step 306; if false, the method 300 ends. The method 300 may determine whether the engine 102 has previously been started based on, for example, the counter value.

In step 306, the method 300 determines whether the engine 102 is running. In other words, the method 300 determines whether the engine speed has been greater than the predetermined speed for the predetermined number of combustion events in step 306. If true, the method 300 continues to step 308; if false, the method remains in step 306.

The method 300 starts the engine runtime timer in step 308 and continues to step 310. The method 300 determines whether the coolant temperature is within the predetermined temperature range in step 310. If true, the method 300 continues to step 312; if false, the method 300 ends.

The method 300 determines whether the engine runtime period is less than the predetermined period in step 312. If true, the method 300 increases the fuel pressure based on the predetermined purging pressure in step 314 and returns to step 312. If false, the method 300 ends. In this manner, the method 300 increases the fuel pressure to the predetermined purging pressure when the engine coolant temperature is within the predetermined range of temperatures and the engine runtime period is less than the predetermined period during the engine runtime period when the engine 102 is started for the first time after assembly.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A fuel pressure control system for a vehicle, comprising:

a pressure regulator module that regulates a fuel pressure supplied to an engine to a first predetermined pressure during an engine running period; and a pressure increasing module that selectively increases said fuel pressure to a second predetermined pressure during said engine running period when a counter value is one of greater than and less than a predetermined final value, wherein said second predetermined pressure is greater than said first predetermined pressure, and wherein said counter value is set to said predetermined final value after said engine is started for a first time after being assembled.

2. The fuel pressure control system of claim 1 wherein said pressure increasing module determines whether to increase said fuel pressure based on an engine coolant temperature and said engine running period when said counter value is said one of greater than and less than said predetermined final value.

3. The fuel pressure control system of claim 1 wherein said pressure increasing module increases said fuel pressure to said second predetermined pressure when an engine coolant temperature is within a predetermined temperature range, said engine running period is less than a predetermined period, and said counter value is said one of greater than and less than said predetermined final value.

4. The fuel pressure control system of claim 1 wherein said pressure regulator module selectively decreases said fuel pressure to a third predetermined pressure that is less than said first predetermined pressure.

5. The fuel pressure control system of claim 1 further comprising an engine runtime module that starts said engine running period when an engine speed is greater than a predetermined speed.

6. The fuel pressure control system of claim 1 further comprising an engine runtime module that starts said engine running period when an engine speed is greater than a predetermined speed for a predetermined number of combustion events.

7. The fuel pressure control system of claim 1 further comprising an engine runtime module that starts said engine running period when an engine speed is greater than a predetermined speed for a predetermined number of consecutive combustion events.

8. The fuel pressure control system of claim 1 wherein said first predetermined pressure is approximately four-hundred (400) kPa and said second predetermined pressure is approximately four-hundred, fifty (450) kPa.

9. The fuel pressure control system of claim 1 wherein said second predetermined pressure is approximately twenty (20) percent greater than said first predetermined pressure.

10. The fuel pressure control system of claim 1 wherein said second predetermined pressure is approximately thirty (30) percent greater than said first predetermined pressure.

11. A fuel pressure control method for a vehicle, comprising:

regulating a fuel pressure supplied to an engine to a first predetermined pressure during an engine running period; and selectively increasing said fuel pressure to a second predetermined pressure during said engine running period when a counter value is one of greater than and less than a predetermined final value, wherein said second predetermined pressure is greater than said first predetermined pressure, and wherein said counter value is set to said predetermined final value after said engine is started for a first time after being assembled.

12. The fuel pressure control method of claim 11 further comprising determining whether to increase said fuel pressure based on an engine coolant temperature and said engine running period when said counter value is said one of greater than and less than said predetermined final value.

13. The fuel pressure control method of claim 11 further comprising increasing said fuel pressure to said second predetermined pressure when an engine coolant temperature is within a predetermined temperature range, said engine running period is less than a predetermined period, and said counter value is said one of greater than and less than said predetermined value.

14. The fuel pressure control method of claim 11 further comprising selectively decreasing said fuel pressure to a third predetermined pressure that is less than said first predetermined pressure.

15. The fuel pressure control method of claim 11 further comprising starting said engine running period when an engine speed is greater than a predetermined speed.

16. The fuel pressure control method of claim 11 further comprising starting said engine running period when an engine speed is greater than a predetermined speed for a predetermined number of combustion events.

17. The fuel pressure control method of claim 11 further comprising starting said engine running period when an engine speed is greater than a predetermined speed for a predetermined number of consecutive combustion events.

18. The fuel pressure control method of claim 11 wherein said first predetermined pressure is approximately four-hundred (400) kPa and said second predetermined pressure is approximately four-hundred, fifty (450) kPa.

19. The fuel pressure control method of claim 11 wherein said second predetermined pressure is approximately twenty (20) percent greater than said first predetermined pressure.

20. The fuel pressure control method of claim 11 wherein said second predetermined pressure is approximately thirty (30) percent greater than said first predetermined pressure.

* * * * *